US011095978B2

(12) United States Patent
Gigandet et al.

(10) Patent No.: US 11,095,978 B2
(45) Date of Patent: Aug. 17, 2021

(54) MICROPHONE ASSEMBLY

(71) Applicant: SONOVA AG, Staefa (CH)

(72) Inventors: Xavier Gigandet, Cousset (CH); Timothee Jost, Auvernier (CH)

(73) Assignee: Sonova AG, Staefa (CH)

( * ) Notice: Subject to any disclaimer, the term of this patent is extended or adjusted under 35 U.S.C. 154(b) by 206 days.

(21) Appl. No.: 16/476,538

(22) PCT Filed: Jan. 9, 2017

(86) PCT No.: PCT/EP2017/050341
§ 371 (c)(1),
(2) Date: Jul. 8, 2019

(87) PCT Pub. No.: WO2018/127298
PCT Pub. Date: Jul. 12, 2018

(65) Prior Publication Data

US 2021/0160613 A1 May 27, 2021

(51) Int. Cl.

| | |
|---|---|
| ***H04R 3/00*** | (2006.01) |
| ***H04R 25/00*** | (2006.01) |
| ***G10L 25/60*** | (2013.01) |
| ***G10L 21/0216*** | (2013.01) |

(52) U.S. Cl.
CPC ..... *H04R 3/005* (2013.01); *G10L 21/0216* (2013.01); *G10L 25/60* (2013.01); *H04R 25/405* (2013.01); *H04R 25/407* (2013.01); *H04R 25/554* (2013.01); *G10L 2021/02166* (2013.01); *H04R 2225/43* (2013.01); *H04R 2430/23* (2013.01)

(58) Field of Classification Search
None
See application file for complete search history.

(56) References Cited

U.S. PATENT DOCUMENTS

| | | | |
|---|---|---|---|
| 9,066,169 | B2 | 6/2015 | Dunn |
| 9,066,170 | B2 | 6/2015 | Forutanpour et al. |
| 2012/0239385 | A1 | 9/2012 | Hersbach et al. |

(Continued)

OTHER PUBLICATIONS

International Search Report received in PCT Patent Application No. PCT/US2017/050341, dated Sep. 12, 2017.

*Primary Examiner* — Paul W Huber
(74) *Attorney, Agent, or Firm* — ALG Intellectual Property, LLC

(57) ABSTRACT

A microphone assembly includes: at least three microphones for capturing audio signals from the user's voice, the microphones defining a microphone plane; an acceleration sensor for sensing gravitational acceleration in at least two orthogonal dimensions so as to determine a direction of gravity; a beamformer unit for processing the captured audio signals in a manner so as to create a plurality of N acoustic beams, a unit for selecting a subgroup of M acoustic beams from the N the acoustic beams; an audio signal processing unit having M independent channels for producing an output audio signal for each of the M acoustic beams; a unit for estimating the speech quality of the audio signal in each of the channels; and an output unit for selecting the signal of the channel with the highest estimated speech quality as the output signal of the microphone assembly.

20 Claims, 5 Drawing Sheets

(56) References Cited

U.S. PATENT DOCUMENTS

| | | | | |
|---|---|---|---|---|
| 2013/0082875 | A1* | 4/2013 | Sorensen | H04R 1/406<br>342/368 |
| 2013/0332156 | A1* | 12/2013 | Tackin | G10L 25/78<br>704/226 |
| 2014/0093091 | A1 | 4/2014 | Dusan et al. | |
| 2014/0270248 | A1 | 9/2014 | Ivanov et al. | |
| 2016/0255444 | A1 | 9/2016 | Bange et al. | |
| 2017/0365249 | A1* | 12/2017 | Dusan | G10L 25/78 |

* cited by examiner

MICROPHONE ASSEMBLY

The invention relates to microphone assembly to be worn at a user's chest for capturing the user's voice.

Typically, such microphone assemblies are worn at the user's chest either by using a clip for attachment to the user's clothing or by using a lanyard, so as to generate an output audio signal corresponding to the user's voice, with the microphone assembly usually including a beamformer unit for processing the captured audio signals in a manner so as to create an acoustic beam directed towards the user's mouth. Such microphone assembly typically forms part of a wireless acoustic system; for example, the output audio signal of the microphone assembly may be transmitted to a hearing aid. Typically, such wireless microphone assemblies are used by teachers of hearing impaired pupils/students wearing hearing aids for receiving the speech signal captured by the microphone assembly from the teacher's voice.

By using such chest-worn microphone assembly, the user's voice can be picked up close to the user's mouth (typically at a distance of about 20 cm), thus minimizing degradation of the speech signal in the acoustic environment.

However, while the use of a beamformer may enhance the signal-to-noise ratio (SNR) of the captured voice audio signal, this requires that the microphone assembly is placed in such a way that the acoustic microphone axis is oriented towards the user's mouth, while any other orientation of the microphone assembly may result in a degradation of the speech signal to be transmitted to the hearing aid. Consequently, the user of the microphone assembly has to be instructed so as to place the microphone assembly at the proper location and with the proper orientation. However, in case that the user does not follow the instructions, only a less than optimal sound quality will be achieved. Examples of proper and improper use of a microphone assembly are illustrated in FIG. 1*a*.

US 2016/0255444 A1 relates to a remote wireless microphone for a hearing aid, comprising a plurality of omnidirectional microphones, a beamformer for generating an acoustic beam directed towards the mouth of the user and an accelerometer for determining the orientation of the microphone assembly relative to the direction of gravity, wherein the beamformer is controlled in such a manner that the beam always points into an upward direction, i.e. in a direction opposite to the direction of gravity.

US 2014/0270248 A1 relates to a mobile electronic device, such as a headset or a smartphone, comprising a directional microphone array and a sensor for determining the orientation of the electronic device relative to the orientation of the user's head so as to control the direction of an acoustic beam of the microphone array according to the detected orientation relative to the user's head.

U.S. Pat. No. 9,066,169 B2 relates to a wireless microphone assembly comprising three microphones and a position sensor, wherein one or two of the microphones are selected according to the position and orientation of the microphone assembly for providing the input audio signal, wherein a likely position of the user's mouth may be taken into account.

U.S. Pat. No. 9,066,170 B2 relates to a portable electronic device, such as a smartphone, comprising a plurality of microphones, a beamformer and orientation sensors, wherein a direction of a sound source is determined and the beamformer is controlled, based on the signal provided by the orientation sensors, in such a manner that the beam may follow movements of the sound source.

It is an object of the invention to provide for a microphone assembly to be worn at a user's chest which is capable of providing for an acceptable SNR in a reliable manner. It is a further object to provide for a corresponding method for generating an output audio signal from a user's voice.

According to the invention, these objects are achieved by a microphone assembly as defined in claims 1 and 37, respectively.

The invention is beneficial in that, by selecting one acoustic beam from a plurality of fixed acoustic beams (i.e. beams which are stationary with regard to the microphone assembly) by taking into account both the orientation of the selected beam with regard to the direction of gravity (or, more precisely, the direction of the projection of the direction of gravity onto the microphone plane) and an estimated speech quality of the selected beam, an output signal of the microphone assembly having a relatively high SNR can be obtained, irrespective of the actual orientation and position on the user's chest relative to the user's mouth.

Having fixed beams allows to have a stable and reliable beamforming stage, while at the same time allowing for fast switching from one beam to another, thereby enabling fast adaptions to changes in the acoustic conditions. In particular, compared to systems using an adjustable beam, i.e. rotating beam with adjustable angular target, the present selection from fixed beams is less complex and is less prone to be perturbed by interferers (environmental noise, neighbouring talker, . . . ); also, adaptive part of such adjustable beam is also critical: If too slow, the system will take time to converge to the optimal solution and part of the talker's speech may be lost; if too fast, then the beam may target interferers during speech breaks.

More in detail, by taking into account both the orientation of the selected beam with regard to gravity and the estimated speech quality of the selected beam, not only a tilt of the microphone assembly with regard to the vertical axis but also a lateral offset with regard to the center of the user's chest may be compensated for. For example, when the microphone assembly is laterally offset, the most vertical beam may not always be the optimal choice, since the user's mouth in such case could be located 30° or more off the vertical axis, so that in the most vertical beam the desired voice signal would be already attenuated, while, when taking into account also the estimated speech quality, a beam close to the most vertical beam may be selected which in such case would provide for a higher SNR than the most vertical beam. Thus, the invention allows for orientation-independent and also partially location-independent positioning of the microphone assembly on the user's chest.

Preferred embodiments are defined in the dependent claims.

Hereinafter, examples of the invention will be illustrated by reference to the attached drawings, wherein:

FIG. 1*a* is a schematic illustration of the orientation of an acoustic beam of a microphone assembly of the prior art with a fixed beam former relative to the user's mouth;

FIG. 1*b* is a schematic illustration of the orientation of the acoustic beam of a microphone assembly according to the invention relative to the user's mouth;

Figure 2:
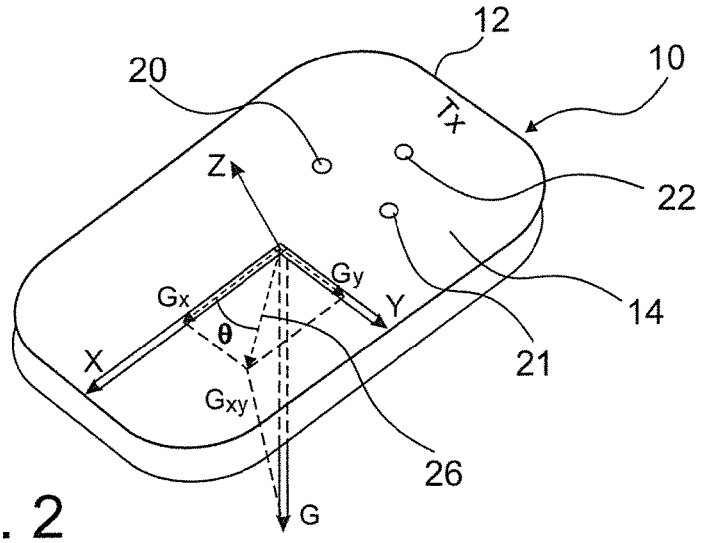
FIG. 2 is a schematic illustration of an example of a microphone assembly according to the invention, comprising three microphones arranged as a triangle.

FIG. 2 is a schematic perspective view of an example of a microphone assembly 10 comprising a housing 12 having essentially the shape of a rectangular prism with a first essentially rectangular flat surface 14 and a second essentially rectangular flat surface (not shown in FIG. 2) which is parallel to the first surface 14. Rather than having a rectangular shape, the housing may have any suitable form factor, such as round shape. The microphone assembly 10 further comprises three microphones 20, 21, 22, which preferably are arranged such that the microphones (or the respective microphone openings in the surface 14) form an equilateral triangle or at least an approximation of a triangle (for example, the triangle may be approximated by a configuration wherein the microphones 20, 21, 22 are distributed approximately uniformly on a circle, wherein each angle between adjacent microphones is from 110 to 130°, with the sum of the three angles being 360°).

According to one example, the microphone assembly 10 may further comprise a clip on mechanism (not shown in FIG. 2) for attaching the microphone assembly 10 to the clothing of a user at a position at the user's chest close to the user's mouth; alternatively, the microphone assembly 10 may be configured to be carried by a lanyard (not shown in FIG. 2). The microphone assembly 10 is designed to be worn in such a manner that the flat rectangular surface 14 is essentially parallel to the vertical direction.

In general, there may be more than three microphones. In an arrangement of four microphones, the microphones still may be distributed on a circle, preferably uniformly. For more than four microphones the arrangement may be more complex, e.g. five microphones may be ideally arranged as the figure five on a dice. More than five microphones preferably would be placed on a matrix configuration, e.g. a 2×3 matrix, 3×3 matrix, etc.

In the example of FIG. 2 the longitudinal axis of the housing 12 is labelled "x", the transverse direction is labelled "y" and the elevation direction is labelled "z" (the z-axis is normal to the plane defined by the x-axis and the y-axis). Ideally, the microphone assembly 10 would be worn in such a manner that the x-axis corresponds to the vertical direction (direction of gravity) and the flat surface 14 (which essentially corresponds to the x-y-plane) is parallel to the user's chest.

Figure 3:
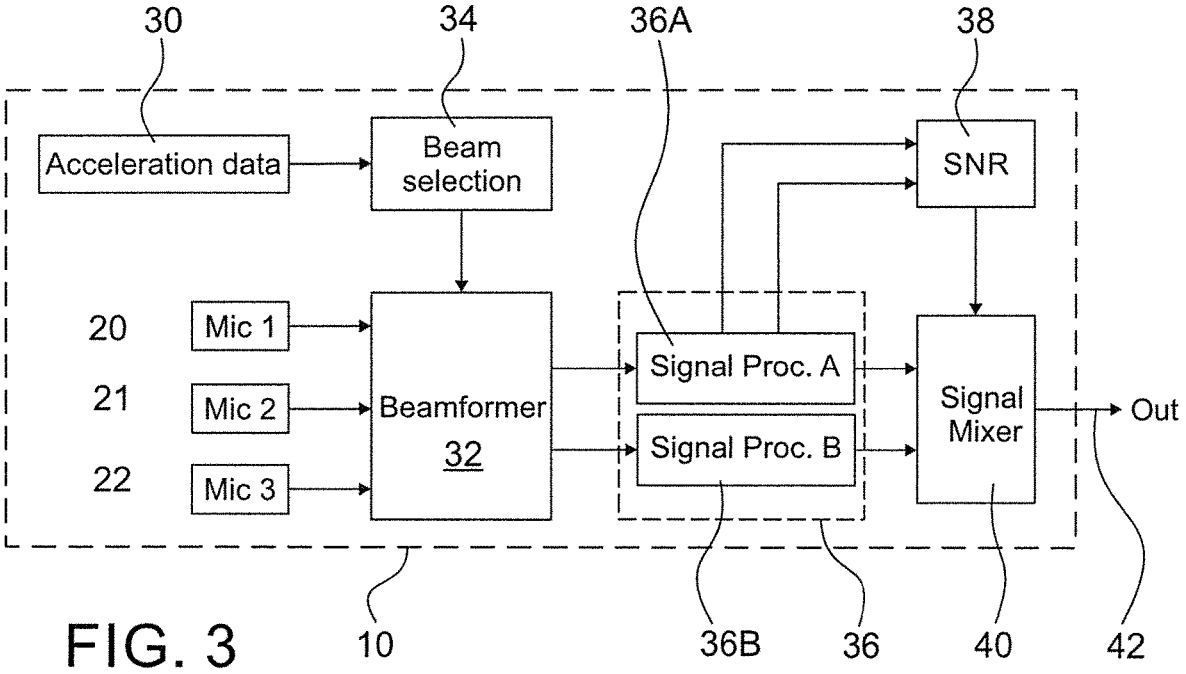
FIG. 3 is an example of a block diagram of a microphone assembly according to the invention.

As illustrated by the block diagram shown in FIG. 3, the microphone assembly further comprises an acceleration sensor 30, a beamformer unit 32, a beam selection unit 34, an audio signal processing unit 36, a speech quality estimation unit 38 and an output selection unit 40.

Figure 4:
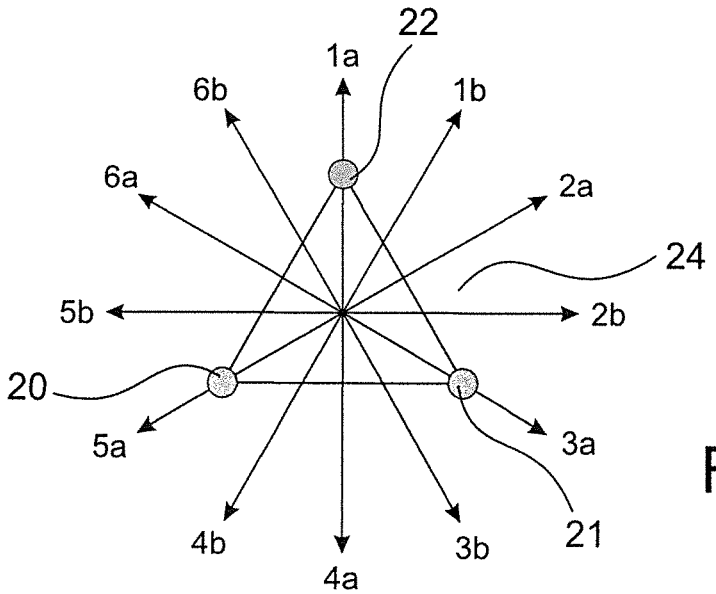
FIG. 4 is an illustration of the acoustic beams produced by the beamformer of the microphone assembly of FIGS. 2 and 3.
Figure 7:
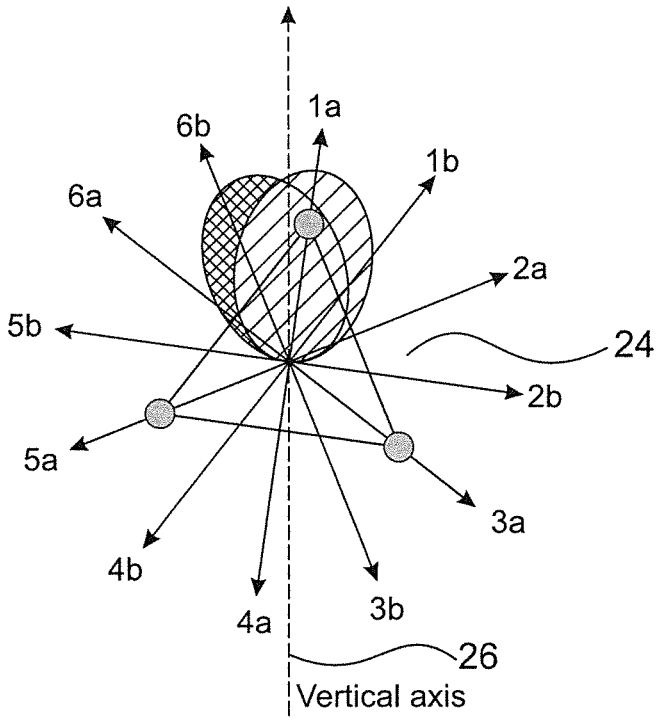
FIG. 7 is a schematic illustration of the selection of one of the beams of FIG. 4 in a practical use case.

The audio signals captured by the microphones 20, 21, 22 are supplied to the beamformer unit 32 which processes the captured audio signals in a manner so as to create 12 acoustic beams 1*a*-6*a*, 1*b*-6*b* having directions uniformly spread across the plane of the microphones 20, 21, 22 (i.e. the x-y-plane), with the microphones 20, 21, 22 defining a triangle 24 in FIG. 4 (in FIGS. 4 and 7 the beams are represented/illustrated by their directions 1*a*-6*a*, 1*b*-6*b*).

Preferably, the microphones 20, 21, 22 are omnidirectional microphones.

The six beams 1*b*-6*b* are produced by delay-and-sum beam forming of the audio signals of pairs of the microphones, with these beams being oriented parallel to one of the sides of the triangle 24, wherein these beams are pairwise oriented antiparallel to each other. For example, the beams 1*b* and 4*b* are antiparallel to each other and are formed by delay-and-sum beam forming of the two microphones 20 and 22, by applying an appropriate phase difference. Such beamforming process may be written in the frequency domain as:

$$Y(k) = \frac{1}{2}\left(M_x(k) - M_y(k)\cdot e^{-j\frac{2\pi k F_s p}{Nc}}\right) \tag{1}$$

wherein $M_x(k)$ and $M_y(k)$ are the spectra of the first and second microphone in bin k, respectively, $F_s$ is the sampling frequency, N is the size of the FFT, p is the distance between the microphones and c is the speed of sound.

Further, the six beams 1*a* to 6*a* are generated by beam forming by a weighted combination of the signals of all three microphones 20, 21, 22, with these beams being parallel to one of the medians of the triangle 24, wherein these beams are pairwise oriented antiparallel to each other. This type of beam forming may be written in the frequency domain as:

$$Y(k) = \frac{1}{2}\left(M_x(k) - \frac{1}{2}(M_y(k) + M_z(k))\cdot e^{-j\frac{2\pi k F_s p_2}{Nc}}\right) \tag{2}$$

wherein $p_2$ is the length of the median of the triangle, $$p_2 = \frac{\sqrt{3}}{2}p.$$

Figure 5:
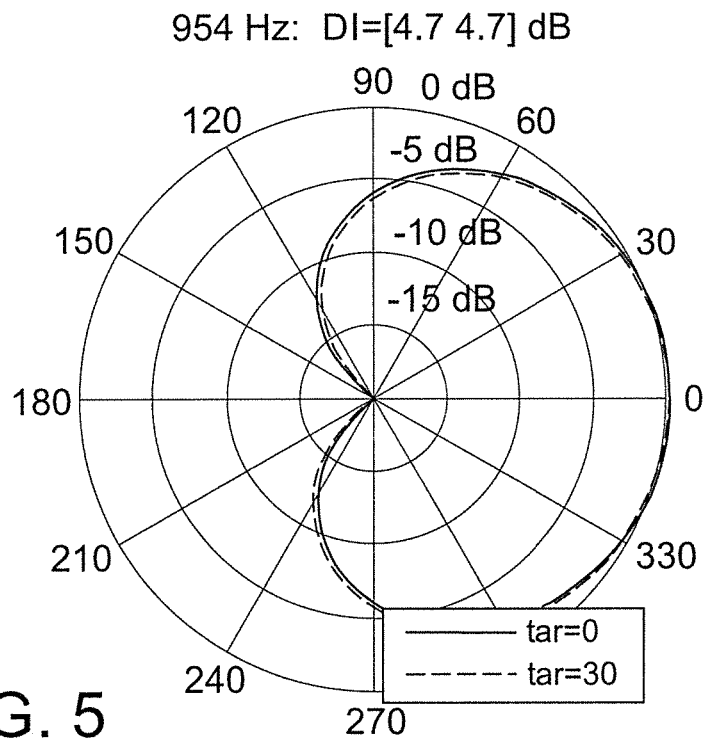
FIG. 5 is an example of a directivity pattern which can be obtained by the beamformer of the microphone assembly of FIGS. 2 and 3.
Figure 6:
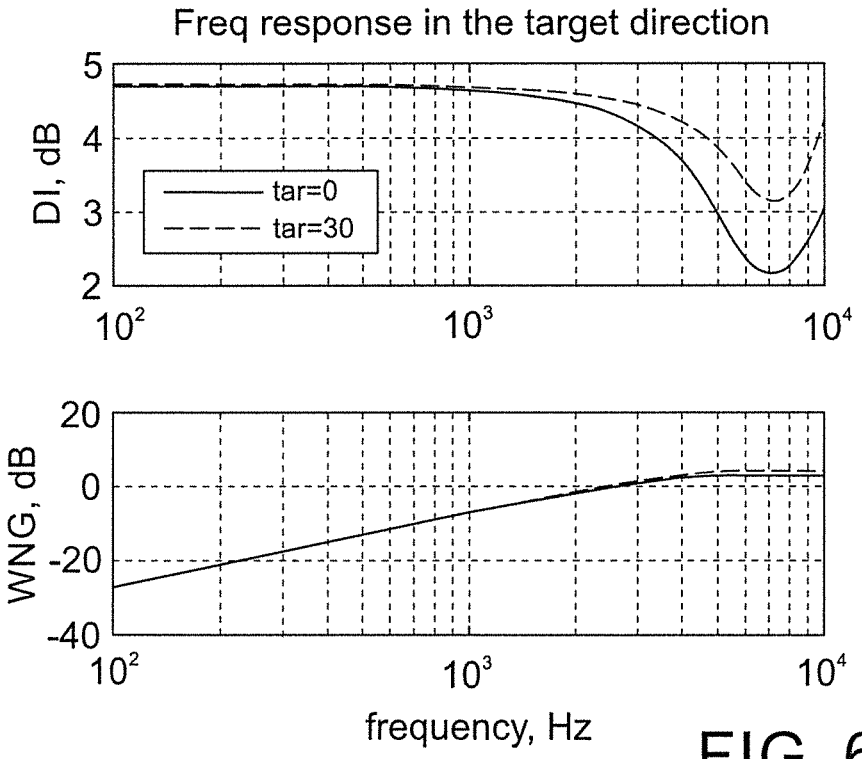
FIG. 6 is a representation of the directivity index (upper part) and of the white noise gain (lower part) of the directivity pattern of FIG. 5 as a function of frequency.

It can be seen from FIGS. 5 and 6 that the directivity pattern (FIG. 5), the directivity index versus frequency (upper part of FIG. 6) and the white noise gain as a function of frequency (lower part of FIG. 6) are very similar for these two types of beamforming (which are indicated by "tar=0" and "tar=30" in FIGS. 5 and 6), with the beams 1*a*-6*a* produced by a weighted combination of the signals of all three microphones providing for a slightly more pronounced directivity at higher frequencies. In practice, however, such difference is inaudible, so that the two types of beam forming can be considered as equivalent.

Rather than using 12 beams generated from three microphones, alternative configurations may be implemented. For example, a different number of beams may be generated from the three microphones, for example only the six beams 1*a*-6*a* of the weighted combination beamforming or only the six beams 1*b*-6*b* of the delay-and-sum beam forming. Further, more than three microphones may be used. Preferably, in any configuration, the beams are uniformly spread across the microphone plane, i.e. the angle between adjacent beams is the same for all beams.

The acceleration sensor 30 preferably is a three-axes accelerometer, which allows to determine the acceleration of the microphone assembly 10 along three orthogonal axes x, y and z. Under stable conditions, i.e. when the microphone assembly 10 is stationary, gravity will be the only contribution to the acceleration, so that the orientation of the microphone assembly 10 in space, i.e. relative to the physical direction of gravity G, can be determined by combining the amount of acceleration measured along each axis, as illustrated in FIG. 2. The orientation of the microphone assembly 10 can be described by the orientation angle θ which is given by atan ($G_y/G_x$), wherein $G_y$ and $G_x$ are the measured projections of the physical gravity vector G along the x-axis and the y-axis. While in general an additional angle ϕ between the gravity vector and the z-axis would have to be combined with the angle θ so as to fully define the orientation of the microphone assembly 10 with regard to the physical gravity vector G, this angle ϕ is not relevant in the present use case, since the microphone array formed by the microphones 20, 21 and 22 is planar. Thus, the determined direction of gravity used by the microphone assembly is actually the projection of the physical gravity vector onto the microphone plane defined by the microphones 20, 21, 22.

The output signal of the accelerometer sensor 30 is supplied as input to the beam selection unit 34 which is provided for selecting a subgroup of M acoustic beams from the N acoustic beams generated by the beamformer 32 according to the information provided by the accelerometer sensor 30 in such a manner that the selected M acoustic beams are those whose direction is closest to the direction antiparallel, i.e. opposite, to the direction of gravity as determined by the accelerometer sensor 30. Preferably, the beam selection unit 34 (which actually acts as a beam subgroup selection unit) is configured to select those two acoustic beams whose direction is adjacent to the direction antiparallel to the determined direction of gravity. An example of such a selection is illustrated in FIG. 7, wherein the vertical axis 26, i.e. the projection $G_{xy}$ of the gravity vector G onto the x-y-plane, falls in-between the beams 1*a* and 6*b*.

Preferably, the beam selection unit 34 is configured to average the signal of the accelerometer sensor 30 in time so as to enhance the reliability of the measurement and thus, the beam selection. Preferably, the time constant of such signal averaging may be from 100 ms to 500 ms.

In the example illustrated in FIG. 7, the microphone assembly 10 is inclined by 10° clockwise with regard to the vertical positions, so that the beams 1*a* and 6*b* would be selected as the two most upward beams. The selection, for example, may be made based on a look-up table with the orientation angle θ as the input, returning the indices of the selected beams as the output. Alternatively, the beam selection unit 34 may compute the scalar product between the vector $-G_{xy}$ (i.e. the projection of the gravity vector G into the x-y-plane) and a set of unitary vectors aligned with the direction of each of the twelve beams 1*a*-6*a* and 1*b*-6*b*, with the two highest scalar products indicating the two most vertical beams:

$$idx_a = \max_i(-G_x B_{a,y,i} - G_y B_{a,x,i}) \quad (3)$$

$$idx_b = \max_i(-G_x B_{b,y,i} - G_y B_{b,x,i}) \quad (4)$$

wherein $idx_a$ and $idx_b$ are the indices of the respective selected beam, $G_x$ and $G_y$ are the estimated projections of the gravity vector and $B_{a,x,i}$, $B_{a,y,i}$, $B_{b,x,i}$ and $B_{b,y,i}$ are the x and y projections of the vector corresponding to the i-th beam of type a or b, respectively.

It is to be noted that such beam selection process according to the signal provided by the accelerometer sensor 30 only works under the assumption that the microphone assembly 10 is stationary, since any acceleration induced by movement of the microphone assembly 10 would bias the estimate of the gravity vector and thus lead to a potentially erroneous selection of beams. In order to prevent such errors, a safeguard mechanism may be implemented by using a motion detection algorithm based on the accelerometer data, with the beam selection being locked or suspended as long as the output of the motion detection algorithm exceeds a predefined threshold.

As illustrated in FIG. 3, the audio signals corresponding to the beams selected by the beam selection unit 34 are supplied as input to the audio signal processing unit 36 which has M independent channels 36A, 36B, . . . , one for each of the M beams selected by the beam selection unit 34 (in the example of FIG. 3, there are two independent channels 36A, 36B in the audio signal processing unit 36), with the output audio signal produced by the respective channel for each of the M selected beams being supplied to the output unit 40 which acts as a signal mixer for selecting and outputting the processed audio signal of that one of the channels of the audio signal processing unit 36 which has the highest estimated speech quality as the output signal 42 of the microphone assembly 10. To this end, the output unit 40 is provided with the respective estimated speech quality by the speech quality estimation unit 38 which serves to estimate the speech quality of the audio signal in each of the channels 36A, 36B of the audio signal processing unit 36.

The audio signal processing unit 36 may be configured to apply adaptive beam forming in each channel, for example by combining opposite cardioids along the direction of the respective acoustic beam, or to apply a Griffith-Jim beamformer algorithm in each channel to further optimize the directivity pattern and better reject the interfering sound sources. Further, the audio signal processing unit 36 may be configured to apply noise cancellation and/or a gain model to each channel.

According to a preferred embodiment, the speech quality estimation unit 38 uses a SNR estimation for estimating the speech quality in each channel. To this end, the unit 38 may compute the instantaneous broadband energy in each channel in the logarithmic domain. A first time average of the instantaneous broadband energy is computed using time constants which ensure that the first time average is representative of speech content in the channel, with the release time being longer than the attack time at least by a factor of 2 (for example, a short attack time of 12 ms and a longer release time of 50 ms, respectively, may be used). A second time average of the instantaneous broadband energy is computed using time constants ensuring that the second time average is representative of noise content in the channel, with the attack time being significantly longer than the release time, such as at least by a factor of 10 (for example, the attack time may be relatively long, such as 1 s, so that it is not too sensitive to speech onsets, whereas the release time is set quite short, such as 50 ms). The difference between the first time average and the second time average of the instantaneous broadband energy provides for a robust estimate of the SNR.

Alternatively, other speech quality measures than the SNR may be used, such as a speech intelligibility score.

The output unit 40 preferably averages the estimated speech quality information when selecting the channel having the highest estimated speech quality. For example, such averaging may employ signal averaging time constants of from 1 s to 10 s.

Preferably, the output unit 40 assesses a weight of 100% to that channel which has the highest estimated speech quality, apart from switching periods during which the output signal changes from a previously selected channel to a newly selected channel. In other words, during times with substantially stable conditions the output signal 42 provided by the output unit 40 consists only of one channel (corresponding to one of the beams 1*a*-6*a*, 1*b*-6*b*), which has the highest estimated speech quality. During non-stationary conditions, when beam switching may occur, such beam/channel switching by the output unit 40 preferably does not occur instantaneously; rather, the weights of the channels are made to vary in time such that the previously selected channel is faded out and the newly selected channel is faded in, wherein the newly selected channel preferably is faded in more rapidly than the previously selected channel is faded out, so as to provide for a smooth and pleasant hearing impression. It is to be noted that usually such beam switching will occur only when placing the microphone assembly 10 on the user's chest (or when changing the placement).

Preferably, safeguard mechanisms may be provided for preventing undesired beam switching. For example, as already mentioned above, the beam selection unit 34 may be configured to analyze the signal of the accelerometer sensor 30 in a manner so as to detect a shock to the microphone assembly 10 and to suspend activity of the beam selection unit 34 so as to avoid changing of the subset of beams during times when a shock is detected, when the microphone assembly 10 is moving too much. According to another example, the output unit 40 may be configured to suspend channel selection, by discarding estimated SNR values during acoustical shocks, during times when the variation of the energy of the audio signals provided by the microphones is found to be very high, i.e. is found to be above a threshold, which is an indication of an acoustical shock, e.g. due to hands clap or an object falling on the floor. Further, the output unit 40 may be configured to suspend channel selection during times when the input level of the audio signals provided by the microphones is below a predetermined threshold or speech threshold. In particular, the SNR values may be discarded in case that the input level is very low, since there is no benefit of switching beams when the user is not speaking.

Figure 1:
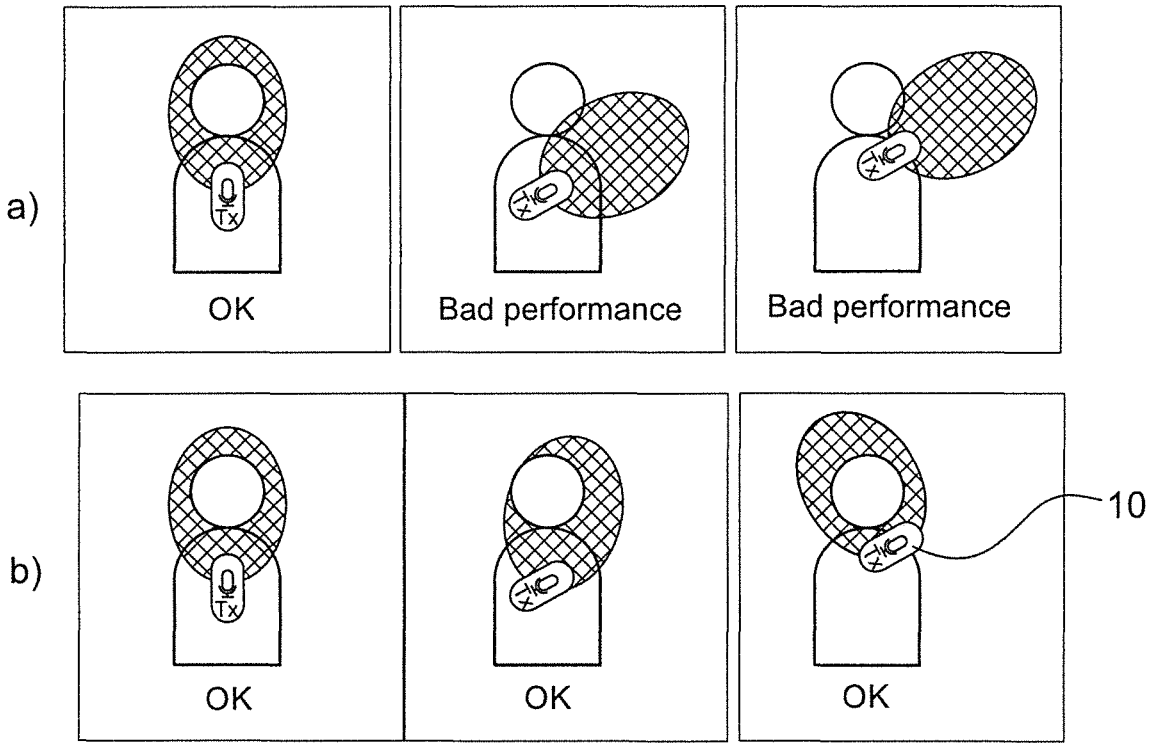

In FIG. 1*b* examples of the beam orientation obtained by a microphone assembly according to the invention are schematically illustrated for the three use situations of FIG. 1*a*, wherein it can be seen that also for tilted and/or misplaced positions of the microphone assembly the beam points essentially towards the user's mouth.

According to one embodiment, the microphone assembly 10 may be designed as (i.e. integrated within) an audio signal transmission unit for transmitting the audio signal output 42 via a wireless link to at least one audio signal receiver unit or, according to a variant, the microphone assembly 10 may be connected by wire to such an audio signal transmission unit, i.e. the microphone assembly 10 in these cases acts as a wireless microphone. Such wireless microphone assembly may form part of a wireless hearing assistance system, wherein the audio signal receiver units are body-worn or ear level devices which supply the received audio signal to a hearing aid or other ear level hearing stimulation device. Such wireless microphone assembly also may form part of a speech enhancement system in a room.

In such wireless audio systems, the device used on the transmission side may be, for example, a wireless microphone assembly used by a speaker in a room for an audience or an audio transmitter having an integrated or a cable-connected microphone assembly which is used by teachers in a classroom for hearing-impaired pupils/students. The devices on the receiver side include headphones, all kinds of hearing aids, ear pieces, such as for prompting devices in studio applications or for covert communication systems, and loudspeaker systems. The receiver devices may be for hearing-impaired persons or for normal-hearing persons; the receiver unit may be connected to a hearing aid via an audio shoe or may be integrated within a hearing aid. On the receiver side a gateway could be used which relays audio signal received via a digital link to another device comprising the stimulation means.

Such audio system may include a plurality of devices on the transmission side and a plurality of devices on the receiver side, for implementing a network architecture, usually in a master-slave topology.

In addition to the audio signals, control data is transmitted bi-directionally between the transmission unit and the receiver unit. Such control data may include, for example, volume control or a query regarding the status of the receiver unit or the device connected to the receiver unit (for example, battery state and parameter settings).

Figure 8:
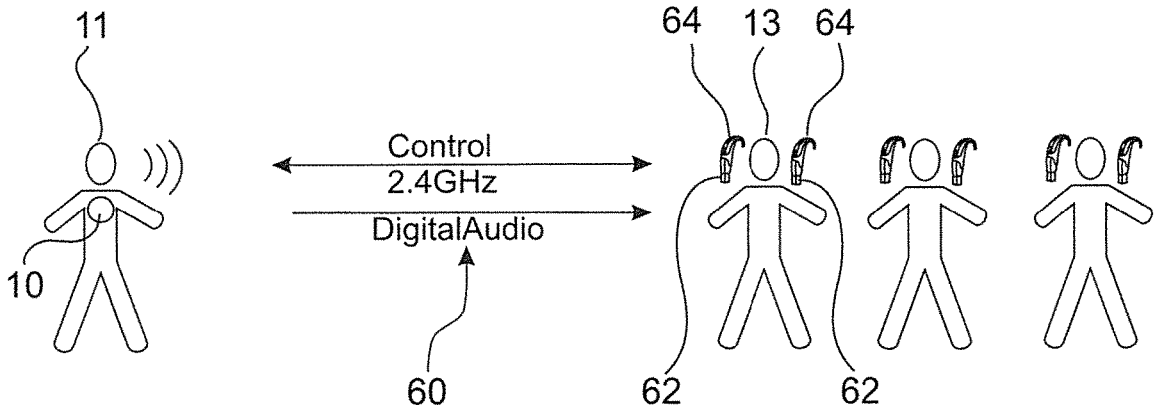
FIG. 8 is an example of a use of a wireless hearing system using a microphone assembly according to the invention.

In FIG. 8 an example of a use case of a wireless hearing assistance system is shown schematically, wherein the microphone assembly 10 acts as a transmission unit which is worn by a teacher 11 in a classroom for transmitting audio signals corresponding to the teacher's voice via a digital link 60 to a plurality of receiver units 62, which are integrated within or connected to hearing aids 64 worn by hearing-impaired pupils/students 13. The digital link 60 is also used to exchange control data between the microphone assembly 10 and the receiver units 62. Typically, the microphone arrangement 10 is used in a broadcast mode, i.e. the same signals are sent to all receiver units 62.

Figure 9:
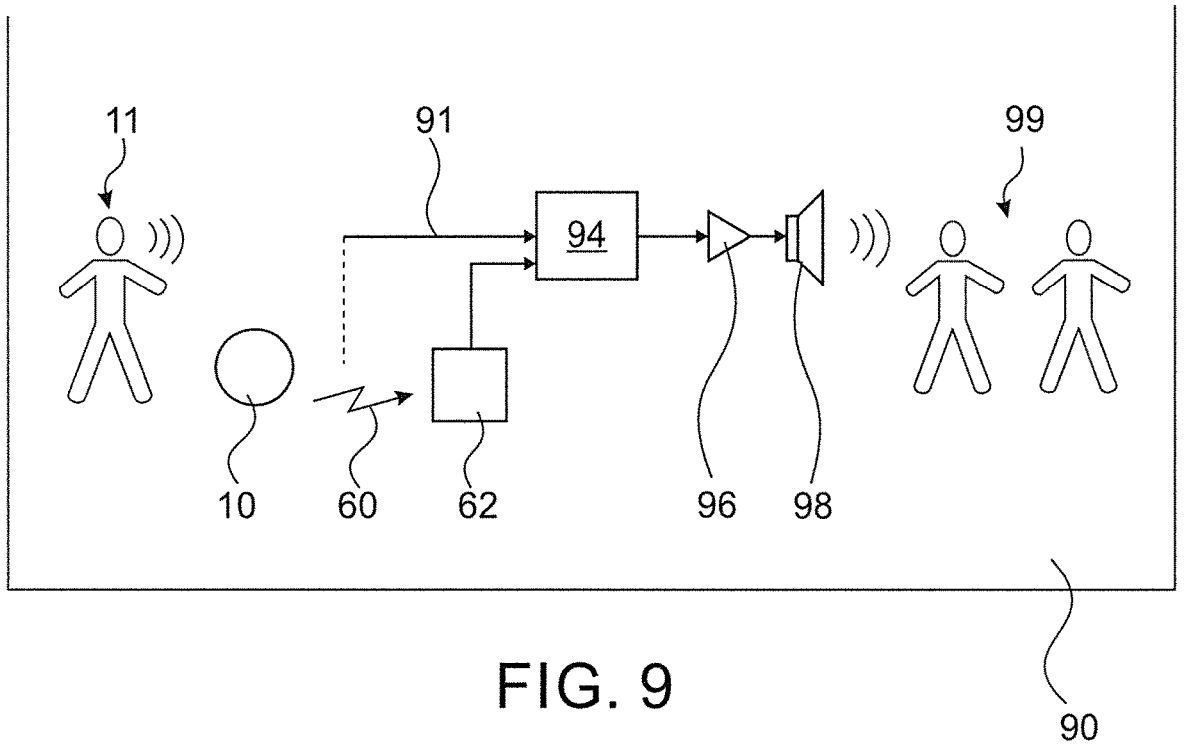
FIG. 9 is a block diagram of a speech enhancement system using a microphone assembly according to the invention.

In FIG. 9 an example of a system for enhancement of speech in a room 90 is schematically shown. The system comprises a microphone assembly 10 for capturing audio signals from the voice of a speaker 11 and generating a corresponding processed output audio signal. The microphone assembly 10 may include, in case of a wireless microphone assembly, a transmitter or transceiver for establishing a wireless—typically digital—audio link 60. The output audio signals are supplied, either by a wired connection 91 or, in case of a wireless microphone assembly, via an audio signal receiver 62, to an audio signal processing unit 94 for processing the audio signals, in particular in order to apply a spectral filtering and gain control to the audio signals (alternatively, such audio signal processing, or at least part thereof, could take place in the microphone assembly 10). The processed audio signals are supplied to a power amplifier 96 operating at constant gain or at an adaptive gain (preferably dependent on the ambient noise level) in order to supply amplified audio signals to a loudspeaker arrangement 98 in order to generate amplified sound according to the processed audio signals, which sound is perceived by listeners 99.

The invention claimed is:

1. A microphone assembly, comprising:

at least three microphones for capturing audio signals from a user's voice, the microphones defining a microphone plane;

an acceleration sensor for sensing gravitational acceleration in at least two orthogonal dimensions so as to determine a direction of gravity ($G_{xy}$);

a beamformer unit for processing the captured audio signals in a manner so as to create a plurality of N acoustic beams having directions spread across the microphone plane, a unit for selecting a subgroup of M acoustic beams from the N acoustic beams, wherein the M acoustic beams are those of the N acoustic beams whose direction is closest to the direction antiparallel to the direction of gravity determined from the gravitational acceleration sensed by the acceleration sensor;

an audio signal processing unit having M independent channels, one for each of the M acoustic beams of the subgroup, for producing an output audio signal for each of the M acoustic beams;

a unit for estimating the speech quality of the audio signal in each of the channels; and an output unit for selecting the signal of the channel with the highest estimated speech quality as the output signal of the microphone assembly.

2. The microphone assembly of claim 1, wherein the beam subgroup selection unit is configured to select, as the subgroup, that two acoustic beams whose direction is adjacent to the direction antiparallel to the determined direction of gravity ($G_{xy}$).

3. The microphone assembly of claim 1, wherein the beam subgroup selection unit is configured to average the measurement signal of the accelerometer sensor in time so as to enhance the reliability of the measurement.

4. The microphone assembly of claim 1, wherein the beam subgroup selection unit is configured to use the projection of the physical direction of gravity onto the microphone plane as said determined direction of gravity for selecting the subgroup of acoustic beams, while neglecting the projection of the physical direction of gravity onto the axis (z) normal to the microphone plane.

5. The microphone assembly of claim 4, wherein the beam subgroup selection unit is configured to compute a scalar product between the projection of the physical direction of gravity onto the microphone plane and a set of unitary vectors aligned to the direction of each of the N acoustic beams and to select that M acoustic beams for the subgroup which result in the M highest scalar products.

6. The microphone assembly of claim 1, wherein the microphone assembly comprises three microphones, and wherein the microphones are distributed approximately uniformly on a circle, and wherein each angle between adjacent microphones is from 110 to 130 degrees, with the sum of the three angles being 360 degrees.

7. The microphone assembly of claim 6, wherein the beamformer unit is configured to create 12 acoustic beams.

8. The microphone assembly of claim 7, wherein the beamformer unit is configured to use delay-and-sum beamforming of the signals of pairs of the microphones for creating a first part of the acoustic beams and to use beamforming by a weighted combination of the signals of all microphones for creating a second part of the acoustic beams.

9. The microphone assembly of claim 8, wherein each of the acoustic beams of the first part of the acoustic beams is oriented parallel to one of the sides of the triangle formed by the microphones, and wherein the acoustic beams of the first part are pairwise oriented antiparallel to each other.

10. The microphone assembly of claim 9, wherein each of the acoustic beams of the second part of the acoustic beams is oriented parallel to one of the medians of the triangle formed by the microphones, and wherein the acoustic beams of the second part are pairwise oriented antiparallel to each other.

11. The microphone assembly of claim 1, wherein the speech quality estimation unit is configured to estimate the signal-to-noise ratio in each channel as the estimated speech quality.

12. The microphone assembly of claim 11, wherein the speech quality estimation unit is configured to compute the instantaneous broadband energy in each channel in the logarithmic domain.

13. The microphone assembly of claim 12, wherein the speech quality estimation unit is configured to compute a first time average of said instantaneous broadband energy using time constants ensuring that the first time average is representative of speech content in the channel, with the release time being longer than the attack time at least by a factor of 2, to compute a second time average of said instantaneous broadband energy using time constants ensuring that the second average is representative of noise content in the channel, with the attack time being longer than the release time at least by a factor of 10, and to use, in a logarithmic domain, the difference between the first time average and the second time average as the signal-to-noise ratio estimation.

14. The microphone assembly of claim 1, wherein the output unit is configured to assess a weight of 100% in the out signal to that channel having the highest estimated speech quality, apart from switching periods during which the output signal changes from a previously selected channel to a newly selected channel.

15. The microphone assembly of claim 14, wherein the output unit is configured to assess, during switching periods, a time variable weighting to the previously selected channel and to the newly selected channel in such a manner that the previously selected channel is faded out and the newly selected channel is faded in.

16. The microphone assembly of claim 1, wherein the output unit is configured suspend the channel selection during times when the variation of the energy level of the audio signals is above a first predetermined threshold or below a second predetermined threshold.

17. The microphone assembly of claim 1, wherein the audio signal processing unit is configured to apply at least one of a Griffith-Jim beamformer algorithm in each channel, noise cancellation to each channel, and a gain model to each channel.

18. The microphone assembly of claim 1, wherein N is equal to 3 and M is equal to 2.

19. A system for providing sound to at least one user comprising:

a microphone assembly, comprising:

at least three microphones for capturing audio signals from a user's voice, the microphones defining a microphone plane;

an acceleration sensor for sensing gravitational acceleration in at least two orthogonal dimensions so as to determine a direction of gravity (G);

a beamformer unit for processing the captured audio signals in a manner so as to create a plurality of N acoustic beams having directions spread across the microphone plane, a unit for selecting a subgroup of M acoustic beams from the N acoustic beams, wherein the M acoustic beams are those of the N acoustic beams whose direction is closest to the direction antiparallel to the direction of gravity determined from the gravitational acceleration sensed by the acceleration sensor;

an audio signal processing unit having M independent channels, one for each of the M acoustic beams of the subgroup, for producing an output audio signal for each of the M acoustic beams;

a unit for estimating the speech quality of the audio signal in each of the channels; and an output unit for selecting the signal of the channel with the highest estimated speech quality as the output signal of the microphone assembly;

the microphone assembly being designed as an audio signal transmission unit for transmitting the audio signals via a wireless link, at least one receiver unit for reception of audio signals from the transmission unit via the wireless link; and a device for stimulating the hearing of the user according to an audio signal supplied from the receiver unit.

20. A method for generating an output audio signal from a user's voice by using a microphone assembly comprising an attachment mechanism, at least three microphones defining a microphone plane, an acceleration sensor, and a signal processing facility, the method comprising:

attaching the microphone assembly by the attachment mechanism to clothing of the user;

sensing, by the acceleration sensor, gravitational acceleration in at least two orthogonal dimensions and determining a direction of gravity ($G_{xy}$);

capturing audio signals from the user's voice via the microphones, processing the captured audio signals in a manner so as to create a plurality of N acoustic beams having directions spread across the microphone plane;

selecting a subgroup of M acoustic beams from the N acoustic beams, wherein the M acoustic beams are those of the N acoustic beams whose direction is closest to the direction antiparallel to the determined direction of gravity;

processing audio signals in M independent channels, one for each of the M acoustic beams of the subgroup, for producing an output audio signal for each of the M acoustic beams;

estimating the speech quality of the audio signal in each of the channels; and selecting the audio signal of the channel with the highest estimated speech quality as the output signal of the microphone assembly.

* * * * *